US009788592B2

(12) United States Patent
Cheng et al.

(10) Patent No.: US 9,788,592 B2
(45) Date of Patent: Oct. 17, 2017

(54) IN-MOULDED HELMET WITH PIVOTABLE SHIELD

(71) Applicant: STRATEGIC SPORTS LIMITED, Kowloon (HK)

(72) Inventors: Tien Hou Cheng, Kowloon (HK); Michael Ming-Jae Lin, Pok Fu Lam (HK)

(73) Assignee: Strategic Sports LLC, Pok Fu Lam, Hong Kong (CN)

( * ) Notice: Subject to any disclaimer, the term of this patent is extended or adjusted under 35 U.S.C. 154(b) by 0 days.

(21) Appl. No.: 14/339,457

(22) Filed: Jul. 24, 2014

(65) Prior Publication Data

US 2015/0082520 A1 Mar. 26, 2015

(30) Foreign Application Priority Data

Sep. 26, 2013 (HK) ..... 13110982

(51) Int. Cl.
*A42B 3/22* (2006.01)
*A42B 3/12* (2006.01)

(52) U.S. Cl.
CPC ..... *A42B 3/222* (2013.01); *A42B 3/12* (2013.01); *A42B 3/226* (2013.01)

(58) Field of Classification Search
CPC ..... A42B 3/222; A42B 3/22; A42B 3/223; A42B 3/226; A42B 3/12
USPC ..... 2/411
See application file for complete search history.

(56) References Cited

U.S. PATENT DOCUMENTS 3,081,460 A * 3/1963 Miller ..... A42B 3/228 2/431
3,310,811 A * 3/1967 Iacono, Jr. ..... A42B 3/08 128/201.24
3,315,272 A * 4/1967 Olt ..... A42B 3/226 2/424
3,345,642 A * 10/1967 Uminski ..... A42B 3/22 2/410
3,353,187 A * 11/1967 Lastnik ..... A42B 3/06 2/412
3,400,407 A * 9/1968 Aileo ..... A42B 3/221 2/427
3,495,273 A * 2/1970 Aileo ..... A42B 3/228 2/6.4
3,543,308 A * 12/1970 Stapenhill ..... A42B 3/226 2/6.4
3,568,211 A * 3/1971 Plaskon ..... A42B 3/228 2/410

(Continued)

*Primary Examiner* — Shaun R Hurley
*Assistant Examiner* — Bao-Thieu L Nguyen
(74) *Attorney, Agent, or Firm* — Wood Herron & Evans LLP

(57) ABSTRACT

A helmet contains a convex, hard outer shell, a concave, impact-dissipating inner layer, a shield, and a shield cover. The concave, impact-dissipating inner layer is fitted to the convex, hard outer shell and contains a front portion having a shield indentation, a back portion, a top portion a right side portion, and a left side portion. The left side portion is opposite the right side portion. The shield is pivotably attached to the helmet via a fulcrum and pivots about the fulcrum. The shield also partially occludes the shield indentation. The shield cover is fixably attached to the helmet and at least partially occludes the front portion. The shield cover also at least partially occludes the shield.

14 Claims, 3 Drawing Sheets

(56) References Cited

U.S. PATENT DOCUMENTS 3,593,338 A * 7/1971 Penny ..... A42B 3/225 2/427
3,721,994 A * 3/1973 DeSimone ..... A42B 3/228 2/10
3,748,657 A * 7/1973 Aileo ..... A42B 3/228 2/410
4,170,042 A * 10/1979 Aileo ..... A42B 3/228 2/424
4,227,520 A * 10/1980 Lord ..... A42B 3/0446 128/201.24
4,305,160 A * 12/1981 Sundahl ..... A42B 3/222 16/334
4,748,696 A * 6/1988 Fohl ..... A42B 3/223 2/10
5,062,162 A * 11/1991 Kamata ..... A42B 3/222 2/424
5,091,997 A * 3/1992 Foehl ..... A42B 3/222 2/424
5,165,117 A * 11/1992 Kamata ..... A42B 3/223 2/424
5,177,817 A * 1/1993 Kamata ..... A42B 3/222 2/424
5,187,502 A * 2/1993 Howell ..... A42B 3/185 2/6.3
5,283,914 A * 2/1994 James ..... A42B 3/16 128/201.24
5,333,329 A * 8/1994 Hong ..... A42B 3/222 2/424
5,448,780 A * 9/1995 Gath ..... A42B 3/08 2/411
5,671,483 A * 9/1997 Reuber ..... A42B 3/24 2/424
5,680,656 A * 10/1997 Gath ..... A42B 3/08 2/411
6,260,213 B1 * 7/2001 Eom ..... A42B 3/222 2/424
6,282,726 B1 * 9/2001 Noyerie ..... A42B 3/226 2/424
6,438,763 B2 * 8/2002 Guay ..... A42B 3/226 2/424
6,598,238 B2 * 7/2003 Hong ..... A42B 3/326 2/424
6,826,783 B1 * 12/2004 Grove ..... A42B 3/10 128/201.25
6,842,913 B1 * 1/2005 Song ..... A42B 3/222 2/424
6,944,887 B2 * 9/2005 Heine ..... A42B 3/226 2/12
7,065,798 B2 * 6/2006 Kuo ..... A42B 3/222 2/424
7,398,561 B2 * 7/2008 Kim ..... A42B 3/326 2/424
7,798,635 B1 * 9/2010 Shindler ..... A42B 3/22 2/424
8,214,919 B2 * 7/2012 Gafforio ..... A42B 3/223 2/410
8,250,669 B2 * 8/2012 Gafforio ..... A42B 3/226 2/12
8,695,121 B2 * 4/2014 Nolan ..... A42B 3/24 2/171.3
8,984,672 B2 * 3/2015 Arnold ..... A42B 3/226 2/424
9,167,861 B2 * 10/2015 Gafforio ..... A42B 3/226
9,277,780 B2 * 3/2016 Hillion ..... A42B 3/105
2001/0032351 A1 * 10/2001 Nakayama ..... A42B 3/064 2/412
2003/0182716 A1 * 10/2003 Wu ..... A42B 3/326 2/424
2007/0056071 A1 * 3/2007 Smith ..... A42B 3/06 2/5
2007/0074335 A1 * 4/2007 Gafforio ..... A42B 3/223 2/410
2007/0124851 A1 * 6/2007 Pyo ..... A42B 3/222 2/424
2008/0196148 A1 * 8/2008 Morin ..... A42B 3/326 2/421
2009/0038057 A1 * 2/2009 Tews ..... A42B 3/24 2/424
2009/0070908 A1 * 3/2009 Gafforio ..... A42B 3/226 2/15
2009/0100576 A1 * 4/2009 Kim ..... A42B 3/326 2/424
2009/0265840 A1 * 10/2009 Favre-Felix ..... A42C 2/007 2/417
2010/0095977 A1 * 4/2010 Schmitz ..... A45D 8/36 132/275
2010/0132096 A1 * 6/2010 Chen ..... A42B 3/226 2/425
2010/0186152 A1 * 7/2010 Freeman ..... A42B 3/226 2/422
2010/0229288 A1 * 9/2010 Higgins ..... A42B 3/185 2/422
2011/0283431 A1 * 11/2011 Miller, IV ..... A42B 3/226 2/10
2011/0302701 A1 * 12/2011 Kuo ..... A42B 3/326 2/421
2012/0102628 A1 * 5/2012 Righi ..... A42B 3/24 2/243.1
2013/0014315 A1 * 1/2013 Valdez Diaz ..... A42B 3/226 2/424
2013/0031699 A1 * 2/2013 Gafforio ..... A42B 3/226 2/411
2013/0212785 A1 * 8/2013 Ratti ..... A42B 3/223 2/421
2014/0189939 A1 * 7/2014 Cheng ..... A42B 3/227 2/422
2014/0317834 A1 * 10/2014 Power ..... A42B 3/221 2/411
2014/0366252 A1 * 12/2014 Mazzarolo ..... A42B 3/127 2/414
2015/0074875 A1 * 3/2015 Schimpf ..... A42B 3/064 2/411
2015/0250253 A1 * 9/2015 Jacobsen ..... A42B 3/12 2/411
2015/0272260 A1 * 10/2015 Ryan ..... A42B 3/226 349/14
2016/0000167 A1 * 1/2016 Alley ..... A42B 3/22 2/412
2016/0000170 A1 * 1/2016 Simons ..... A42B 3/185 2/424

* cited by examiner

IN-MOULDED HELMET WITH PIVOTABLE SHIELD

FIELD OF THE INVENTION

The present invention relates to a helmet with a shield, more specifically, a helmet having a pivotable shield.

BACKGROUND

Helmets protect a person's head during, for example, a crash or a fall. Helmets are used in a variety of different sports and occupations, such as, for example, bicycle riding, American Football, motorcycle racing, horse riding, ice hockey, fire fighting, etc. Such helmets are typically formed by well known assembly processes, including but not limited to in-moulding processes involving the use of a hollow mould into which an expandable material, such as a foam and/or a foam precursor is added. The mould is typically heated up prior to or during the process, and often a vacuum is applied to help expand the foam and/or foam precursor.

In-moulding, also known as injection-moulding and co-injection moulding, is well-known in the art of helmet making for combining a hard outer layer with an inner polystyrene shape. Processes are also known for adding a lacquered outer layer to a STYROFOAM®, polystyrene foam, or other foam helmet. Other processes are known for injecting a pre-mixture of, for example expandable poly styrene (EPS) beads and spongy particles into a mould together so as to allegedly produce a helmet with a balance between impact protection and impact absorption. In some cases expandable poly propylene (EPP) beads are used as well. Some processes apply different materials into the mould at the same time, while other processes first form the pieces separately and then affix them together afterwards.

Other assembly process are also well-known in the helmet art, including moulding, fitting, etc. Oftentimes polycarbonate, plastic and/or composite parts are formed separately and then assembled together via screws, fasteners, etc. Designs, liners, foam padding, etc. may be added as well. Othertimes the manufacturer makes as much as possible together in a single mould.

Pivotable face shields are also well-known in fill-face helmets, such as motorcycle/racing helmets a dirt bike helmets. In a racing helmet, the face shield is typically formed of PLEXIGLAS® or other clear plastic and tends to cover the face, either partially or completely. Such a clear face shield is often required for safety and to meet various regulatory requirements. Face shields are often able to pivot up relative to the bicycle helmet so as to, for example, allow the user to clean condensation from the inside of the bicycle helmet without taking it off. However, such face shields are usually intended to be permanently affixed to the bicycle helmet as removing them may potentially cause safety issues during subsequent use. Nonetheless, some motorcycle helmet face shields are intended to be removable and/or replaceable by the user.

In cases such as horse riding and BMX-biking, full-face helmets are sometimes used and these may have sun visors affixed thereupon. Such sun visors are typically opaque and shield the face from the sun much like the bill of a baseball cap. Such sun visors are typically permanently fixed to the bicycle helmet and are unmovable—i.e., they are not intended to be removed by the bicycle helmet user.

Certain motorcycle helmets include a pivotable, tinted internal shield which is inside of the normal pivotable face shield. Such a dual shield system is intended to reduce glare, block ultraviolet (UV) rays, etc. and thereby replace sunglasses during riding, while also allowing high visibility during low light and night conditions. Due to the dual-layer construction, such a pivotable internal shield is typically controlled by an external control lever such as in the SHOEI® GT-AIR™ helmet with an internal sun shield (see, for example, http:/lwww.shoei-helmets.corn/gt-air.aspx). The external control lever allows the user to slide the sun shield up into concealment, or down to cover the eyes, without having to open the external face shield. Such a system is useful in wet or high speed conditions. However, such a system requires a deformation of the forehead portion of the outer helmet layer which can affect aerodynamics, weight distribution and balance, and other factors. Such a construction method also requires extra complexity and is not suited to simpler helmets such as, for example, bicycle helmets, ski helmets, etc.

Accordingly, there remains a need for an improved helmet, especially an in-moulded helmet, having a pivoting visor which is, for example, easily constructed in an efficient manner, and/or has a removable/replaceable shield. There also remains a need for a simple helmet with a pivotable shield, such as a sun shield, which is at least somewhat protected from scratching, cracking, etc.

SUMMARY OF THE INVENTION

The present invention relates to a helmet containing a convex, hard outer shell, a concave, impact-dissipating inner layer, a shield, and a shield cover. The concave, impact-dissipating inner layer is fitted to the convex, hard outer shell. The concave, impact-dissipating inner layer contains a front portion having a shield indentation, a back portion opposite the front portion, a top portion joining the front portion and the back portion, a right side portion joining the front portion, the back portion, and the top portion, and a left side portion joining the front portion, the back portion, and the top portion. The left side portion is opposite the right side portion. The shield is pivotably attached to the helmet via a fulcrum and pivots about the fulcrum. The shield also partially occludes the shield indentation. The shield cover is fixably attached to the helmet and at least partially occludes the front portion. The shield cover also at least partially occludes the shield.

Without intending to be limited by theory, it is believed that the present invention provides significant advantages such as, for example, protection of the shield when not in use (i.e., when stored behind the shield cover) which leads to reduced scratching, abrasion, etc., a more durable shield, greater flexibility of the shield during use, reduced manufacturing complexity, reduced manufacturing time, etc.

The figures herein are for illustrative purposes only and not necessarily drawn to scale.

DESCRIPTION OF THE PREFERRED EMBODIMENTS

Unless otherwise specifically provided, all tests herein are conducted at standard conditions which include a room and testing temperature of 25° C., sea level (1 atm.) pressure, pH 7, as appropriate, and all measurements are made in metric units. Furthermore, all percentages, ratios, etc. herein are by weight, unless specifically indicated otherwise.

Unless otherwise explicitly indicated, as used herein the terms "internal", "inner" and "inside" indicate a relative position towards the helmet portion which is or would be closer to the wearer's head. Unless otherwise explicitly indicated, as used herein the terms "exterior", "outer" and "external" indicate a relative position towards the helmet portion which is or would be closer to the outside of a helmet which is or would be away from the wearer's head.

An embodiment of the present invention relates to a helmet; or an in-moulded helmet; containing a convex, hard outer shell, a concave, impact-dissipating inner layer, a shield and a shield cover. The concave, impact-dissipating inner layer is fitted to; or in-moulded with; the convex, hard outer shell. The concave, impact-dissipating inner layer contains a front portion with a shield indentation; a back portion opposite the front portion; a top portion joining the front portion and the back portion; an right side portion joining the front portion, the back portion and the top portion; and a left side portion joining the front portion, the back portion and the top portion. The shield is pivotably attached to the helmet by a fulcrum and at least partially occludes the shield indentation. The shield cover is fixably attached to the helmet at least partially occludes the front portion, and at least partially occludes the shield.

Figure 1:
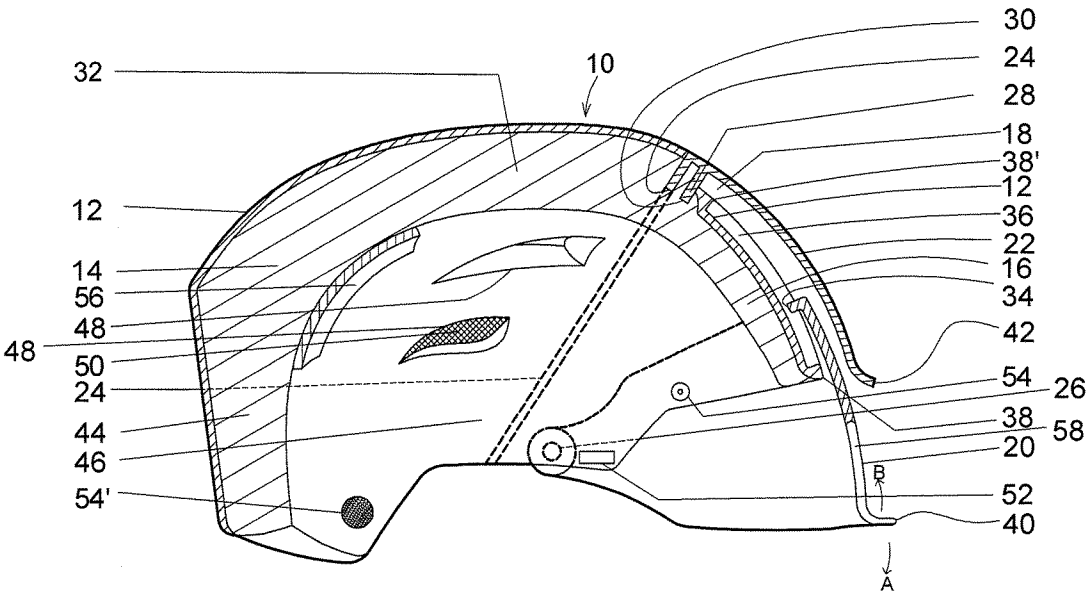
FIG. 1 shows a cut-away view of embodiment of the present invention showing the shield and the shield cover.

Turning to the figures, FIG. 1 shows an in-moulded helmet, 10, having (as viewed from the outside) a convex, hard outer shell, 12, and (as viewed from the inside) a concave, impact-dissipating inner layer, 14, that is fitted to, preferably in-moulded with, the hard outer shell, 12. The convex shape of the hard outer shell, 12, therefore covers the concave shape of the inner layer, and in the embodiment of FIG. 1, the hard outer shell is physically and/or chemically-bound to most, if not all of the inner layer.

In embodiments where the hard outer shell is separately formed from the inner layer, it may be fitted thereto and attached with fasteners, bolts, screws, etc. as desired. Alternatively, an adhesive may be used as well. If in-moulded, then the hard outer shell is typically permanently bound to the impact-dissipating member during the in-moulding process.

The hard outer shell serves multiple purposes such as aesthetics, additional impact dissipation, friction reduction, etc. For example, the hard outer shell may have various pigments, patterns, and/or textures thereupon or therein, including those recognizable as designs, logos, brand names, etc. In an embodiment herein, the hard outer shell is a hard, brittle material such as, for example, polycarbonate, polystyrene, or the like, which is intended to shatter upon impact so as to further dissipate the impact of a collision. In theory, such a shattering of the shell propagates the impact force in a lateral direction, so as to reduce the force transmitted through to the impact-dissipating material. A shattered or cracked hard outer shell after an impact may also be an indication that the impact was so great that structural integrity of the helmet may have been compromised, and therefore indicate to the user that the helmet should be replaced with a new helmet, checked for structural integrity and/or repaired.

In an embodiment herein the hard outer shell contains a shell material selected from a polymeric material; or from a polycarbonate, a polystyrene, a polyacrylate and a mixture thereof; or from an extruded polystyrene, acrylonitrile butadiene styrene, an expanded polystyrene, and a mixture thereof; or acrylonitrile butadiene styrene, an expanded polystyrene; and a mixture thereof.

In an embodiment herein, the hard outer shell contains a friction-reducing material selected from polytetraflouroethylene, perfluoroalkoxy, fluorinated ethylene propylene, aluminium magnesium boride, nylon, acetal, ultra high molecular weight polyethylene, and a mixture thereof. Such a friction-reducing material is especially useful in, for example, a racing helmet or a helmet intended for use in a competitive sport/activity.

The inner layer is formed of an impact-dissipating material typically selected from a polymeric material; or from a polystyrene, a polypropylene, and a mixture thereof; or from an extruded polystyrene, an expanded polystyrene; expanded polypropylene, and a mixture thereof; or an expanded polystyrene, and a mixture thereof. Without intending to be limited be theory, we believe that these materials provide a good balance between factors such as cost, weight, durability, impact-dissipation, formability, comfort, stability across various temperature ranges, etc. Expanded polystyrene especially tends to be light and also able to withstand both high and low temperature extremes and maintain its physical shock-absorbing properties for use in, for example, skiing helmets as well as water sport helmets.

FIG. 1 shows that the helmet, 10, contains a front portion, 16, which is intended to cover the user's forehead (not shown). The front portion, 16, contains a shield indentation, 18, which is, in FIG. 1, a cut-out of the hard outer shell, 12, and the inner layer, 14, which accommodates the shield, shield, 20, and the shield cover, 22. The shield, 20, is pivotally-attached to the helmet, 10, and in this embodiment, the shield, 20, is pivotally-attached to the hard outer shell, 12. In the embodiment of FIG. 1, the shield cover, 22, fits into a notch, 24, in the hard outer layer, 12, and the inner layer, 14. In FIG. 1, this notch runs transversely across the front portion, 16, roughly from the position of one temple to the other temple (see also FIG. 2 at 24), and helps to hold the shield cover, 22, in place.

In the embodiment of FIG. 1, the shield indentation, 18, portion of the helmet, 10, is also covered by the hard outer shell, 12, but such a feature is optional. In an embodiment herein the shield indentation is not covered by the hard outer shell, or is only partially covered by the hard outer shell, so as to conserve resources, such as the shell material.

The shield, 20, is typically formed of a shield material selected from, for example, a plastic, glass, a polymer, a resin, and a combination thereof, or PLEXIGLAS®, polyethylene, acrylic polymers, silicone polymers/copolymers, polycarbonate (e.g., LEXAN®), nylon, styrene, and a combination thereof or PLEXIGLAS®, acrylonitrile butadiene styrene, polycarbonate, polyethylene and a combination thereof. The shield may be coated with a film, if desired to provide various physical or chemical qualities such as, but not limited to, shatter resistance, scratch or abrasion resistance, ultraviolet (UV) protection, tinting, light wavelength filtering/absorption, reflectance (e.g., mirrored films), and a combination thereof. The shield, 20, may be transparent or tinted as desired, and is typically tinted to absorb visible light such that the total luminous transmittance ($T_1$) according to the *American Society for Testing and Materials* ASTM D1003 11 e1 according to the section "7. Procedure A—Hazemeter" with a sample cut to 50 mm×50 mm square and a thickness of 2 mm is from about 10% to about 100% or from about 25% to about 95% or from about 35% to about 90%. In an embodiment herein the shield is tinted so as to absorb from about 10% to about 100% or from about 25% to about 95% or from about 35% to about 90% of a visible light wavelength of from about 7000 Å to about 4000 Å; or to absorb from about 10% to about 100% or from about 25% to about 50% or from about 35% to about 90% of a visible light wavelength selected from red light (at about 6870 Å), yellow light (at about 5875 Å), green light (at about 5132 Å), blue light (at about 4560 Å), and a combination thereof. In an embodiment herein the shield (and/or a coating thereupon) is tinted a color selected from yellow, brown, grey, black and a combination thereof. In an embodiment herein the tint in the shield is comparable to that used in the sunglasses industry. In an embodiment herein the shield has a mirror-like reflective surface. Without intending to be limited by theory, it is believed that such a shield helps to protect the user's eyes from bright light, excessive ultraviolet (UV) light, etc. This can be a great benefit during use, as, for example, the user would not need to wear sunglasses at the same time, thereby increasing comfort and usability.

In an embodiment herein the helmet contains a plurality of shields; or from about 2 to about 4 shields, or about 2 shields. In an embodiment where there is a plurality of shields, then each shield may have different characteristics, such as, for example, a first shield to reduce glare during the daytime, and a second shield to enhance vision during low light conditions, in snowy conditions, etc. In such a case, the various shields may be attached at the same place and possess a common fulcrum, may each possess a separate fulcrum, or anywhere in between.

In an embodiment herein the helmet contains one shield.

In an embodiment herein, the shield includes a corrective lens; or corrects a condition selected from the group consisting of myopia, hyperopia, presbyopia, astigmatism and a combination thereof; or includes at least one prescription lens. In an embodiment herein the shield contains a corrective lens customized for a particular user. A corrective lens as used herein indicates a portion of the shield which is shaped, treated, formed, etc. such that it corrects for abnormalities in the vision or enhances the vision of the user. In an embodiment herein the shield contains multiple corrective lenses. In an embodiment herein the corrective lens has a plurality of focal lengths; or is a bifocal lens or a trifocal lens; or is a bifocal lens.

In an embodiment herein the shield is designed to be replaceable by the user, such that it may be easily removed and replaced with another shield with differing properties, (e.g., a lighter or darker tint, different color, etc.) or with another shield with the same properties (e.g., if the original shield is damaged, etc.). In such an embodiment, the replacement of the shield may employ merely simple, common tools, or even no tools at all. In an embodiment of a kit herein, a customized tool is provided to the user for use in replacing the shield.

The shield cover, 22, may be made of a material similar to that of the shield, or a different material. In an embodiment herein the shield cover is formed from substantially the same material as the hard outer shell. In an embodiment herein the colour, design, or combination thereof of the shield cover is substantially the same as the hard outer shell. In an embodiment herein the colour, design, or combination thereof of the shield cover is different from the hard outer shell.

If the shield cover, 22, is intended to protect the shield, 20, from scratches, abrasion, etc., then the shield cover may be formed of a tougher and/or more resilient material such as a metal, a plastic, a laminate, and a combination thereof or aluminum, polypropylene, nylon, acrylonitrile butadiene styrene, and a combination thereof or a hard plastic. In an embodiment herein the shield cover, 22, and the hard outer shell, 12, and the notch, 24, are designed with relatively tight manufacturing tolerances so as to reduce air resistance when the helmet, 10, is in use.

In FIG. 1, the shield, 20, and the shield cover, 22, are also both attached to the helmet, 10, by a fulcrum, 26, about which the shield, 20, is able to pivot. In an embodiment, the fulcrum is formed by a fastener such as a screw. Typically there will be a fulcrum on each opposing side of the helmet providing a pair of fulcrums (e.g., a screw on the left side portion and a corresponding screw on the right side portion) about which the shield, 20, pivots. The fulcrum, 26, may be any type of fastener which both securely holds the shield, 20, in place, and also allows the shield, 20, to pivot up pivot up and down. In an embodiment herein the fulcrum is selected from a bolt, a screw, a snap-fit fastener, a peg, a cog, a gear, and a combination thereof; or a bolt, a screw, a snap-fit fastener, and a combination thereof. The fulcrum may be formed of, for example, metal, plastic, wood and a combination thereof; or plastic, metal and a combination thereof.

While in FIG. 1, the shield cover, 22, is also held in place by the fulcrum, 26, this is an optional, though preferred feature. In other embodiments, the shield and the shield cover may be held in place by separate methods, structures, fasteners, etc.

Figure 2:
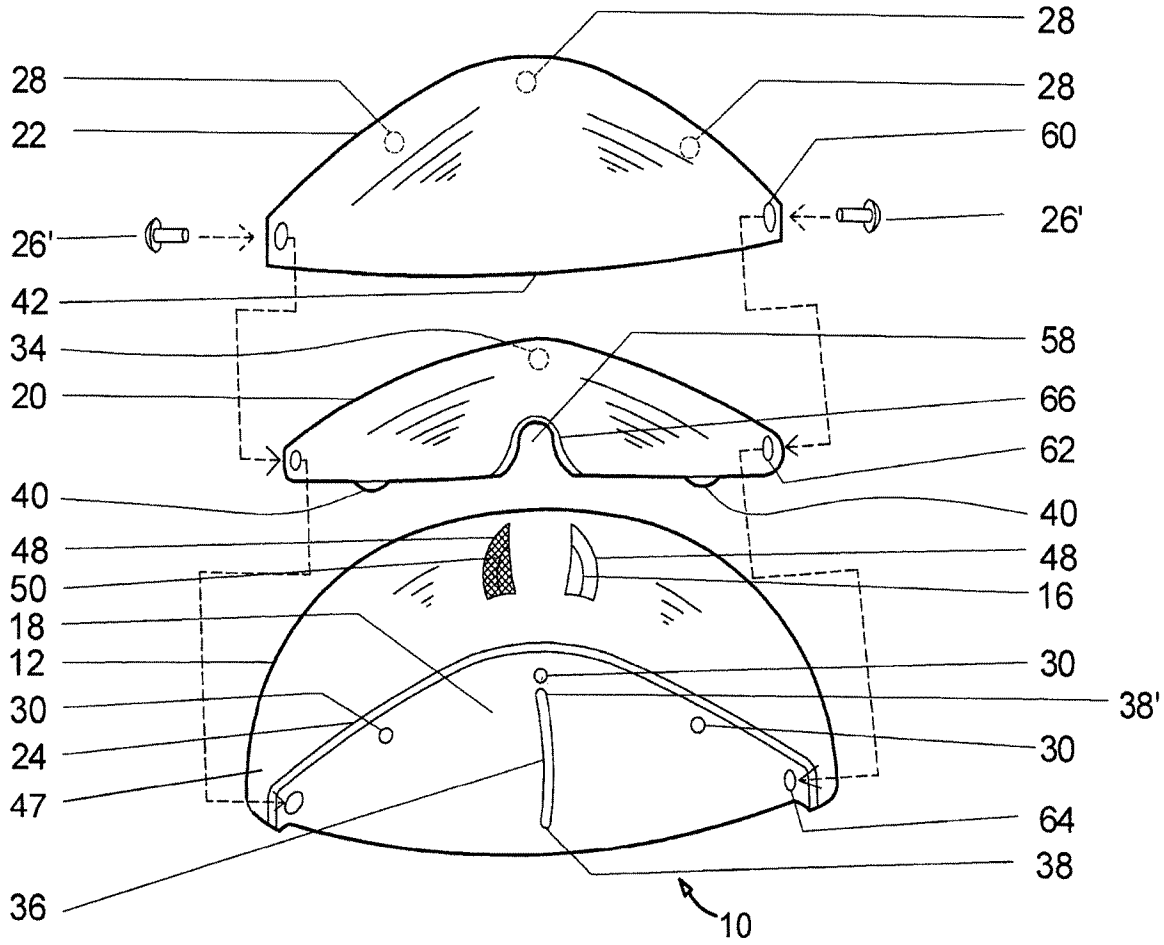
FIG. 2 shows an exploded front view of an embodiment of the present invention.

In FIG. 1, the edge of the shield cover, 22, fits into the notch, 24, which helps to properly position the shield cover, 22, and prevent it from moving. In addition, in this embodiment, an optional support peg, 28, is fitted into a support hole, 30, which further provides structural stability to reduce the chance that the shield cover, 22, will be deformed in case of an impact. Although not shown in FIG. 1, one skilled in the art understands that the helmet may possess a plurality of support pegs and corresponding support holes, on, for example, the shield cover and the front portion, respectively. Such features are shown in FIG. 2.

The shield, 20, is attached such that it may at least partially; or at least partially covers the shield indentation, 18, especially when the visor is pivoted up above the front portion, 16, towards the top portion, 32. For example, it can be seen that the shield, 20, may be pivoted down, in the direction of arrow A, or the shield, 20, may be pivoted up, in the direction of arrow B. When the user does not wish to look through the shield, 20, they will pivot the shield, 20, up in the direction of arrow B, so that the shield, 20, substantially retracts into the shield indentation, 18. Conversely, when the user wishes to see through the shield, 20, they will pivot the shield, 20, down in the direction of arrow A, so that the shield, 20, is at least partially removed from the shield indentation, 18, and is lowered in front of the user's eyes.

In FIG. 1, the shield, 20, contains a alignment peg, 34, which fits into and slides along an alignment groove, 36. The alignment groove, 36, interacts with the alignment peg, 34 so as to physically limit the shield, 20, movement and to prevent the shield, 20, from overextending when pivoted down in the direction of arrow A. When the shield, 20, is pivoted down, the alignment peg, 34, eventually hits the stopper, 38, at the bottom end of the alignment groove, 36, which prevents further pivoting of the shield, 20. Conversely, when the shield, 20, is pivoted up in the direction of arrow B, the alignment peg, 34, eventually hits the stopper, 38', which prevents further pivoting of the shield, 20. This in turn prevents the shield, 20, from being pivoted up so far that the shield, 20, gets stuck, lost, or jammed under the shield cover, 22.

In an embodiment herein, the shield, the shield indentation, and the shield are designs such that the arcs (or their 3D equivalents) they form are portions of concentric circles and/or spheres, respectively. Without being limited by theory, it is believed that such a design increases the chances that the shield, shield cover, and/or the shield indentation are compatible during use and reduces jamming and rubbing. This way, for example, it is unlikely that the shield will pivot in such a way that the shield cover or the shield indentation unintentionally block the pivoting motion.

In FIG. 1, the shield, 20, further contains a shield lip, 40, which the user may hold when pivoting the shield, 20, up or down. In an embodiment herein, the shield cover, 22, also contains a shield cover lip, 42. In such an embodiment, the shield lip, 40, and shield cover lip, 42, are typically designed such that the shield lip, 40, further prevents the shield from pivoting too far. For example, the shield lip, 40, may be designed such that it extends farther forward than the shield cover lip, 42. In an embodiment herein, the shield lip is located to either the left side and/or the right side of the shield; or the right side of the shield; as seen by the user when wearing the helmet, so as to be more easily accessible to a user during use. Such a shield lip location allows the user to pivot the shield up or down without blocking their vision directly in front of their face.

In FIG. 1, the helmet, 10, also has a back portion, 44, opposite the front portion, 16. A left side portion, 46, is shown joining the front portion, 16, the back portion, 44, and the top portion, 32. The right side portion 47 (shown in FIG. 2), is opposite the left side portion, 46.

The helmet, 10, includes an optional vent, 48, which passes through both the inner layer, 14, and the hard outer shell, 12, so as to allow air to circulate within the helmet, 10. In an embodiment herein, the helmet contains a plurality of vents; or from about 1 to about 40 vents; or from about 2 to about 30 vents; or from about 4 to about 20 vents. Such vents may be located in various positions designed to enhance air flow and/or to reduce air resistance. In FIG. 1, a vent, 48, contains a mesh, 50, which prevents and/or reduces debris and/or insects entering the helmet via the vents while simultaneously allowing air to freely flow therethrough. In an embodiment herein, one or more vents are located proximal to the junction where the shield cover and the notch meet.

In FIG. 1, the helmet, 10, includes additional optional items such as, for example, a chin strap tab, 52, ear holes (not shown), an accessory attachment point, 54, etc. to allow various additional structures to be attached to the helmet. Such optional items may be integrally moulded therein, permanently affixed thereto, or removably affixed thereto. In an embodiment herein, the accessory attachment point, 54, is formed of a hook-and-loop fastener such as, for example, the hook portion, 54', of such a fastener system. Then, the corresponding accessory, such as a comfort-enhancing member, 56, shown in FIG. 1 as a foam pad, may then contain the loop portion (not shown) of the fastener system, and thereby removably attach to the helmet, 10. In another embodiment, the accessory attachment point is a male or female portion of a snap-fit fastener.

The comfort-enhancing member may be attached with, for example, a removable and/or a low-strength adhesive, a hook-and-loop fastener system such as VELCRO®, by employing a key-and-lock type fastener, a removeable snap fit fastener, or other methods known in the art. Such a removable comfort-enhancing member may be desirable to enable washing, replacement, etc. of the comfort-enhancing member. Such fasteners and adhesives are well-known in the art and available from multiple suppliers world-wide.

The comfort-enhancing member may be formed of any useful material known in the art, such as, for example, a plastic, rubber, a foam, cloth, and a combination thereof; or a memory foam, cloth, a porous plastic, rubber and a combination thereof, or a memory foam, cloth, and a combination thereof. Without intending to be limited by theory, it is believed that a memory foam provides improved comfort to the user, while a cloth or a porous plastic provides sweat wicking and breathability properties that enhance the comfort of the user. In an embodiment herein the comfort-enhancing member is balloon-like and inflated with a gas such as air or an inert gas. In an embodiment herein, the comfort-enhancing member is a balloon-like inflatable structure. In an embodiment herein the balloon-like inflatable structure is adjustable by the user.

In an embodiment herein the comfort-enhancing member may also serve to reduce the amount of impact force transmitted to the user's head and body. Such an impact force reduction may be due to, for example absorption or dissipation of at least a portion of the impact force. This, in turn, may reduce injury to the head, neck, spine, etc.

In FIG. 1, the shield, 20, also has a nasal opening, 58, such as seen on goggles, sunglasses, etc. to accommodate the nose of the user. See also FIG. 2 at 58.

FIG. 2 shows an exploded front view of the helmet, 10, shield, 20, and shield cover, 22. As can be seen, the shield, 20, fits into the shield indentation, 18, which is then covered by the shield cover, 22. The fulcrums, 26, which in FIG. 2 is a bolt, 26', on each side of the shield cover, 22, hold the helmet, 10, shield, 20, and shield cover, 22, together. In this embodiment, the shield cover, 22, contains a shield cover fulcrum hole, 60, while the shield, 20, contains a shield fulcrum hole, 62, and the helmet, 10, contains a helmet fulcrum hole, 64. The bolt, 26', goes through first the shield cover fulcrum hole, 60, then the shield fulcrum hole, 62, and finally the helmet fulcrum hole, 64, and is affixed with, for example, a nut, or other fastener (not shown). This allows pivoting of the shield, shield, 20, about the fulcrum, 26.

In FIG. 2, it can be seen that the support pegs, 28, on the inner side of the shield cover, 22, may fit into the support holes, 30, in the shield indentation, 18. Furthermore, it can be seen that the alignment peg, 34, on the inner side of the shield, 20, may fit into the alignment groove, 36 in the shield indentation, 18.

In FIG. 2, the shield, 20, contains an optional nose pad, 66, which may increase the comfort for the user by, for example, cushioning the shield, 20, to prevent it from striking the user's nose during use. The nose pad may improve comfort when the helmet is shaking. The nose pad may also improve comfort by, for example, absorbing sweat, etc. In an embodiment herein, the nose pad is removable by the user, for cleaning, replacement, etc. In an embodiment herein the nose pad is soft, and may contain cloth, rubber, foam, plastic, and a combination thereof, or cloth, foam rubber, and a combination thereof.

FIG. 2 also shows an external view of some of the features described in FIG. 1. For example, the helmet, 10, contains vents, 48, one of which contains a mesh, 50, therein. The vent, 48, forms a hole through both the hard outer shell, 12, as well as the inner layer, 16. Also, the shield, 20, contains a shield lip, 40, while the shield cover, 22, contains a shield cover lip, 42. In FIG. 2, the shield lip, 40, is on both the left and right sides of the shield, 20, so as to allow the user to adjust the shield, 20, with either the left or right hand, without obstructing his/her view.

FIG. 2 also shows the notch, 24, in the helmet, 10, which may hold the edge of the shield cover, 22. The alignment groove, 36 as well as multiple support holes, 30, and the stoppers, 38, 38', at the end of the alignment groove, 36, are all shown as well. In FIG. 2, it can be seen that the stopper, 38, is simply the end of the alignment groove, 36. However, in another embodiment, the stopper, 38, may be an additional structure, such as a plastic or rubber pad which physically stops the alignment peg, 34, from physically moving too far.

Figure 3:
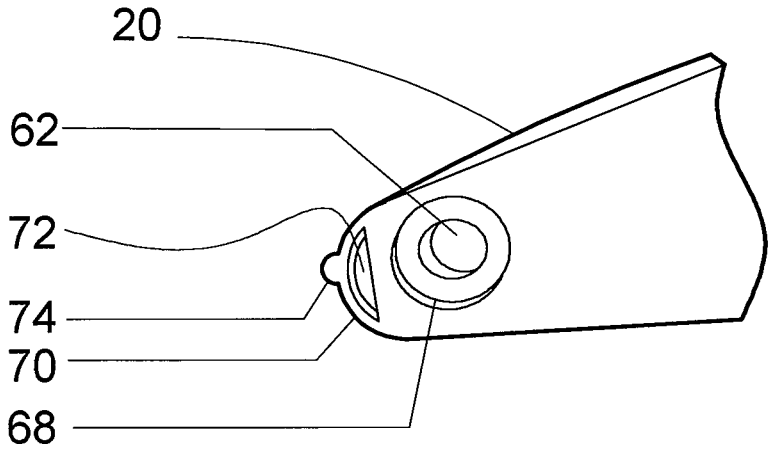
FIG. 3 shows a close up partial view of an embodiment of a shield.

FIG. 3 shows a partial view of an embodiment of a shield, 20, as seen from the outside of the shield, 20; i.e., as if from the shield cover, 22. FIG. 3 shows an end of the shield, 20, where the shield fulcrum hole, 62, is located. Adjacent to the shield fulcrum hole, 62, is a shield fulcrum hole edge, 68, which is an indentation in the shield, 20, that matches/fits the corresponding fulcrum (see FIG. 4 at 26). The end of the shield, 20, also contains a flexible tab, 70, that is able to bend and flex due to the flex hole, 72, cut adjacent to the flexible tab, 70. A locking numb, 74, is also located on the flexible tab, 70.

Figure 4:
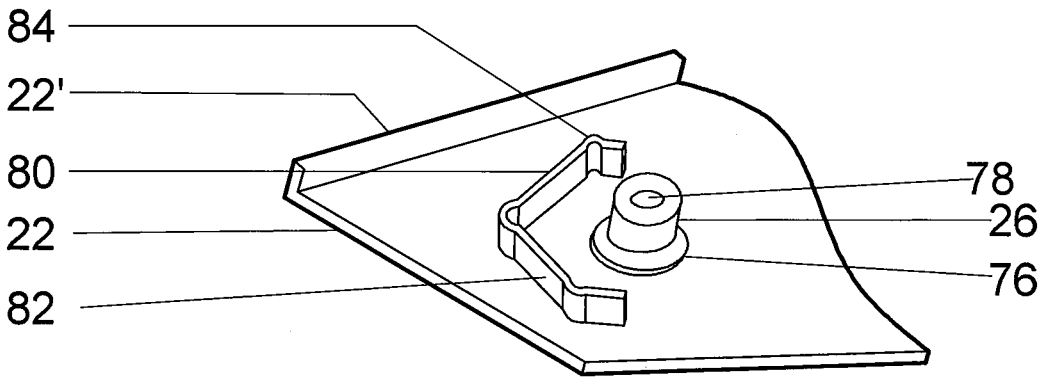
FIG. 4 shows a close up partial view of an embodiment of a shield cover.

FIG. 4 shows a partial view of an embodiment of the shield cover, 22, herein. The shield, 20, at FIG. 3 fits into and cooperates with the shield cover, 22, of FIG. 4. Thus, looking art FIG. 3 and FIG. 4 together, the fulcrum, 26, fits through the shield fulcrum hole, 60, to form the fulcrum, 26, about which the shield, 20, may pivot. The fulcrum edge, 76, in FIG. 4 cooperates with the shield fulcrum hole edge, 68, and allows further structural stability when the shield, 20, pivots. A screw, bolt, or other fastener may pass through the attachment hole, 78, so as to permanently or temporarily affix the shield, 20, to the shield cover, 22. In some embodiments herein, the attachment hole, 78, may also correspond to the shield cover fulcrum hole (see FIG. 2, at 60).

FIG. 4 also shows a locking mechanism, 80, which fits together with the flexible tab, 70. In the embodiment herein, the locking mechanism, 80, is formed of a straight edge, 82; or at least one straight edge, 82; or from about one straight edge, 82, to about six straight edges, 82; or from about two straight edges, 82, to about four straight edges, 82; and a dimple, 84; or at least one a dimple, 84; or from about one dimple, 84, to about seven dimples, 84; or from about one dimple, 84, to about five dimples, 84. The locking nub, 74, is adjacent to the flexible tab, 70, and fits into the dimple, 84, so as to prevent the shield, 20, from pivoting unless a predetermined amount of force is applied to the shield, 20, such as, for example, by the user purposely pushing or pulling the shield, 20, up or down. Without intending to be limited by theory, it is believe that this is a surprisingly simple yet effective manner to prevent the shield, 20, from undesirably moving during helmet, 10, use. Such a mechanism is easy to make, sturdy, and easily assembled, while providing exceptionally functional usability. The flexible tab, 70, and the tolerances between the flexible tab, 70, and the locking mechanism, 80, are such that a predetermined amount of force is needed to move the shield, 20. Without intending to be limited by theory, it is believed that this then prevents the shield from unintentionally moving when, for example, the helmet is subject to normal shaking and sudden movement.

FIG. 4 also shows the portion of the shield cover, 22', which fits into the notch (see FIG. 1 at 24 and FIG. 2 at 24) and prevents the shield cover, 22, from moving.

In an embodiment herein the helmet is an in-moulded helmet. Furthermore, while the specification herein distinctly describes an in-moulded helmet, one skilled in the art would understand that they technology herein is applicable to a wide variety of helmets and not only those that are in-moulded. Accordingly, even though the present invention provides distinct advantages to an in-moulded helmet, one skilled in the art would not believe that the invention is limited thereto.

In an embodiment herein the helmet is a skating helmet, a cycling helmet, a snow helmet, a water sport helmet, or a combination thereof or a skating helmet, a cycling helmet, a snow helmet, or a combination thereof or a skating helmet, a snow helmet, or a combination thereof. A skating helmet is intended to protect the user while engaging in skating-type sports/activities and may be, for example, a roller skating helmet, an in-line skating helmet, a skateboarding helmet, an ice-skating helmet, or a combination thereof, or a competitive roller skating helmet, a competitive in-line skating helmet, a competitive skateboarding helmet, a competitive ice-skating helmet, or a combination thereof. A cycling helmet is intended to protect the user while engaging in cycling-type sports/activities such as riding a unicycle, a bicycle, a tricycle, a quadracycle, and other human-powered vehicles. Thus, a cycling helmet is typically a recreational cycling helmet, a competitive cycling helmet, or a combination thereof. A snow helmet is a helmet intended to protect the user while engaging in snow-related sports/activities and may be, for example, a skiing helmet, a snowmobile helmet, a snowboarding helmet, etc.; or a skiing helmet, a snowboarding helmet, or a combination thereof or a competitive skiing helmet, a competitive snowboarding helmet; or a combination thereof. A water sport helmet is intended to protect the user while engaging in water sports/activities and may be, for example, a water skiing helmet, a boating helmet, a jet-skiing helmet, an inner-tubing helmet, a canoeing helmet, a rafting helmet, or a combination thereof.

It should be understood that the above only illustrates and describes examples whereby the present invention may be carried out, and that modifications and/or alterations may be made thereto without departing from the spirit of the invention.

It should also be understood that certain features of the invention, which are, for clarity, described in the context of separate embodiments, may also be provided in combination in a single embodiment. Conversely, various features of the invention which are, for brevity, described in the context of a single embodiment, may also be provided for separately or in any suitable subcombination.

What is claimed is:

1. A helmet comprising:

a convex, hard outer shell;

a concave, polymeric impact-dissipating inner layer and wherein said concave polymeric impact dissipating inner layer is in-moulded with the convex, hard outer shell and a shield indentation formed in said impact-dissipating inner layer which is adapted to cover a forehead of a cycle user, the concave, polymeric impact-dissipating inner layer comprising:

a front portion fixed to said shield indentation;

a back portion opposite the front portion;

a top portion joining the front portion and the back portion;

a right side portion joining the front portion, the back portion and the top portion; and a left side portion joining the front portion, the back portion and the top portion, wherein the left side portion opposes the right side portion;

a shield pivotably attached to the helmet by a fulcrum, wherein the shield at least partially occludes the shield indentation; and a shield cover, separate from said outer shell, fixably attached to the helmet, wherein the shield cover at least partially occludes the front portion, and wherein the shield cover at least partially occludes the shield, wherein the shield pivots about the fulcrum.

2. The helmet according to claim 1, wherein the shield is transparent.

3. The helmet according to claim 1, wherein the shield is tinted.

4. The helmet according to claim 1, wherein the helmet is a cycling helmet.

5. The helmet according to claim 1, wherein the shield cover substantially covers the shield indentation.

6. The helmet according to claim 1, wherein the front portion further comprises an alignment groove, wherein the shield further comprises an alignment peg, wherein the alignment peg engages the alignment groove, and wherein the alignment groove physically limits the movement of the alignment peg so as to limit the pivoting of the shield.

7. The helmet according to claim 1 wherein the shield cover is opaque.

8. The helmet according to claim 1, wherein the shield cover is fixably attached to the convex, hard outer shell.

9. The helmet according to claim 1, comprising a plurality of shields.

10. The helmet according to claim 1, wherein the shield comprises a corrective lens.

11. The helmet according to claim 1, wherein the helmet is an in-moulded helmet.

12. The helmet according to claim 1, wherein the helmet is selected from the group consisting of a skating helmet, a cycling helmet, a snow helmet, a water helmet, and a combination thereof.

13. The helmet according to claim 1, further comprising a locking mechanism on the shield cover and a flexible tab on the shield, wherein the locking mechanism cooperates with the flexible tab to prevent the shield from unintentionally moving.

14. The helmet according to claim 13 wherein the locking mechanism is formed of a straight edge and a dimple, wherein the shield further comprises a locking nub adjacent to the flexible tab, and wherein the locking nub may fit into the dimple.

* * * * *